US010113238B2

(12) United States Patent
Mukai et al.

(10) Patent No.: US 10,113,238 B2
(45) **Date of Patent: *Oct. 30, 2018**

(54) GOLD PLATE COATED STAINLESS MATERIAL AND METHOD OF PRODUCING GOLD PLATE COATED STAINLESS MATERIAL

(71) Applicant: TOYO KOHAN CO., LTD., Tokyo (JP)

(72) Inventors: Nobuaki Mukai, Kudamatsu (JP); Takahiro Yoshida, Kudamatsu (JP)

(73) Assignee: TOYO KOHAN CO., LTD., Tokyo (JP)

( * ) Notice: Subject to any disclaimer, the term of this patent is extended or adjusted under 35 U.S.C. 154(b) by 154 days.

This patent is subject to a terminal disclaimer.

(21) Appl. No.: 14/897,093

(22) PCT Filed: Sep. 20, 2013

(86) PCT No.: PCT/JP2013/075562

§ 371 (c)(1),
(2) Date: Dec. 9, 2015

(87) PCT Pub. No.: WO2014/199526

PCT Pub. Date: Dec. 18, 2014

(65) Prior Publication Data

US 2016/0130701 A1 May 12, 2016

(30) Foreign Application Priority Data

Jun. 13, 2013 (JP) ..... 2013-124693

(51) Int. Cl.
*B32B 9/00* (2006.01)
*C23C 18/31* (2006.01)
(Continued)

(52) U.S. Cl.
CPC ..... *C23C 18/31* (2013.01); *C23C 18/1834* (2013.01); *C23C 18/44* (2013.01);
(Continued)

(58) Field of Classification Search
None
See application file for complete search history.

(56) References Cited

U.S. PATENT DOCUMENTS 5,275,696 A 1/1994 Gaskin et al.
10,000,038 B2 * 6/2018 Mukai ..... C23C 18/50
(Continued)

FOREIGN PATENT DOCUMENTS

CN 102239593 A 11/2011
CN 102713004 A 10/2012
(Continued)

OTHER PUBLICATIONS

Tawfik et.al. J. Power Sources, 2007, 755-767.*
(Continued)

*Primary Examiner* — Seth Dumbris
(74) *Attorney, Agent, or Firm* — Muncy, Geissler, Olds & Lowe, P.C.

(57) ABSTRACT

There is provided a gold plate coated stainless material characterized by comprising: a stainless steel sheet formed with a passivation film having a surface of which a Cr/O value is within a range of 0.05 to 0.2 and a Cr/Fe value is within a range of 0.5 to 0.8 when measured by Auger electron spectroscopy analysis; and a gold plated layer formed on the passivation film of the stainless steel sheet. According to the present invention, there can be provided a gold plate coated stainless material which can be improved in the coverage and interfacial adhesion property of the gold plated layer formed on the stainless steel sheet even when reducing the thickness of the gold plated layer, thereby to be
(Continued)

excellent in corrosion resistance and conductivity and advantageous in cost.

8 Claims, 11 Drawing Sheets

(51) Int. Cl.

| | |
|---|---|
| ***C23C 18/44*** | (2006.01) |
| ***C23C 22/50*** | (2006.01) |
| ***C23G 1/08*** | (2006.01) |
| ***C23C 18/18*** | (2006.01) |
| ***C23C 28/00*** | (2006.01) |
| ***C23C 18/54*** | (2006.01) |

(52) U.S. Cl.
CPC ..... *C23C 18/54* (2013.01); *C23C 22/50* (2013.01); *C23C 28/322* (2013.01); *C23C 28/3455* (2013.01); *C23G 1/081* (2013.01)

(56) References Cited

U.S. PATENT DOCUMENTS

| | | | | |
|---|---|---|---|---|
| 2006/0159971 | A1 | 7/2006 | Takagi et al. | |
| 2010/0035115 | A1 | 2/2010 | Takagi et al. | |
| 2011/0250522 | A1 | 10/2011 | Kaminaka et al. | |
| 2011/0287336 | A1* | 11/2011 | Himeno | H01M 8/0213 429/492 |
| 2013/0108945 | A1 | 5/2013 | Ishii et al. | |
| 2014/0154129 | A1 | 6/2014 | Makiishi et al. | |
| 2016/0340786 | A1* | 11/2016 | Mukai | C23C 18/42 |

FOREIGN PATENT DOCUMENTS

| | | | |
|---|---|---|---|
| EP | 2 343763 | A1 | 7/2011 |
| JP | 58-058296 | A | 4/1983 |
| JP | 61-243193 | A | 10/1986 |
| JP | 09-217166 | | 8/1997 |
| JP | 2008-004498 | A | 1/2008 |
| JP | 2010-236091 | A | 10/2010 |
| JP | 2011-099128 | A | 5/2011 |
| JP | 2013-028849 | A | 2/2013 |

OTHER PUBLICATIONS

JP10228914_MT Aug. 25, 1998.*
JP2010236091_MT Oct. 21, 2010.*
Office Action dated Dec. 22, 2016 in corresponding CN Application 201380077395.9 and an English translation thereof, 19 pages.
Chinese Office Action dated Sep. 5, 2017 in corresponding CN Application No. 201380077395.9, w/English-translation, 18 pages.

* cited by examiner (A)Fe2p (B)Ni2p (C)Cr2p (D)O1s (A) Example 2
(immersion of 10 seconds)

(B) Comparative Example 2
(immersion of 60 seconds)

(C) SUS316L
(untreated)

(A) Example 2
(immersion of 10 seconds)

(B) Comparative Example 2
(immersion of 60 seconds)

Amorphous Ni oxide or fine crystal of Ni oxide (C) SUS316L
(untreated)

(A) Example 4
(before formation of gold plated layer 20)

(B) Example 4
(after formation of gold plated layer 20)

(C) Example 4
(after image processing)

GOLD PLATE COATED STAINLESS MATERIAL AND METHOD OF PRODUCING GOLD PLATE COATED STAINLESS MATERIAL

BACKGROUND OF THE INVENTION

1. Technical Field of the Invention

The present invention relates to a gold plate coated stainless material and a method of producing a gold plate coated stainless material.

2. Description of the Related Art

As an electrical contact material such as used for connectors, switches or printed wiring boards, there has conventionally been used a gold plate coated stainless material configured such that the surface of a stainless steel sheet is coated with a gold plated layer.

Usually, in such a gold plate coated stainless material formed with a gold plated layer at the surface, an underlying nickel plating is performed to form an underlying nickel plated layer on the stainless steel sheet before forming the gold plated layer, in order to improve the interfacial adhesion property of the gold plated layer at the surface. In this case, when the gold plated layer is formed on such an underlying nickel plated layer, if defects such as pinholes occur in the gold plated layer, nickel will dissolve from the underlying nickel plated layer thereby to cause delamination of the gold plated layer, which may be problematic.

To overcome this problem, for example, Patent Document 1 (Japanese Patent Application Publication No. 2008-4498 A) discloses a technique of forming a gold plated layer directly on a stainless steel sheet without performing such underlying nickel plating.

SUMMARY OF THE INVENTION

According to the above technique as disclosed in Patent Document 1, however, problems may arise in that, if the thickness of the gold plated layer at the surface is unduly thin, the coverage of the gold plated layer will be significantly reduced thereby to deteriorate the interfacial adhesion property of the gold plated layer, and the stainless steel sheet will be exposed to readily corrode, while on the other hand an unduly thick thickness of the gold plated layer at the surface will lead to disadvantages in cost.

The present invention has been made in consideration of such actual circumstances, and an object of the present invention is to provide a gold plate coated stainless material which can be improved in the coverage and interfacial adhesion property of the gold plated layer even when reducing the thickness of the gold plated layer at the surface, thereby to be excellent in corrosion resistance and conductivity and advantageous in cost.

As a result of intensive studies to achieve the above object, the present inventors have found that the above object can be achieved by forming a certain passivation film on a stainless steel sheet and forming a gold plated layer on the passivation film, and the present inventors have accomplished the present invention.

That is, according to an aspect of the present invention, there is provided a gold plate coated stainless material. The gold plate coated stainless material is characterized by comprising: a stainless steel sheet formed with a passivation film having a surface of which a Cr/O value is within a range of 0.05 to 0.2 and a Cr/Fe value is within a range of 0.5 to 0.8 when measured by Auger electron spectroscopy analysis; and a gold plated layer formed on the passivation film of the stainless steel sheet.

In the gold plate coated stainless material of the present invention, the gold plated layer may preferably have a coverage of 95% or more.

According to another aspect of the present invention, there is provided a method of producing a gold plate coated stainless material. The method comprises: an immersing step of immersing a stainless steel sheet in a sulfuric acid aqueous solution; and a plating step of forming a gold plated layer on the stainless steel sheet. The method is characterized in that the immersing step satisfies Expression (1) below:

$$0.6\times10^6 \le x^2\cdot(y-40)^2\cdot\sqrt{z} \le 3.0\times10^6 \quad (1)$$

where x represents a sulfuric acid concentration [vol %] ($20\le x\le 25$), y represents a temperature [° C.], and z represents an immersion time [seconds] when the stainless steel sheet is immersed in the sulfuric acid aqueous solution.

According to a further aspect of the present invention, there is provided a method of producing a gold plate coated stainless material. The method is characterized by comprising: an immersing step of immersing a stainless steel sheet in a sulfuric acid aqueous solution thereby to form a passivation film on the stainless steel sheet, the passivation film having a surface of which a Cr/O value is within a range of 0.05 to 0.2 and a Cr/Fe value is within a range of 0.5 to 0.8 when measured by Auger electron spectroscopy analysis; and a plating step of forming a gold plated layer on the passivation film of the stainless steel sheet.

According to the present invention, there can be provided a gold plate coated stainless material which can be improved in the coverage and interfacial adhesion property of the gold plated layer formed on the stainless steel sheet even when reducing the thickness of the gold plated layer, thereby to be excellent in corrosion resistance and conductivity and advantageous in cost.

DESCRIPTION OF THE PREFERRED EMBODIMENT

The gold plate coated stainless material 100 according to the present embodiment will hereinafter be described.

Figure 1:
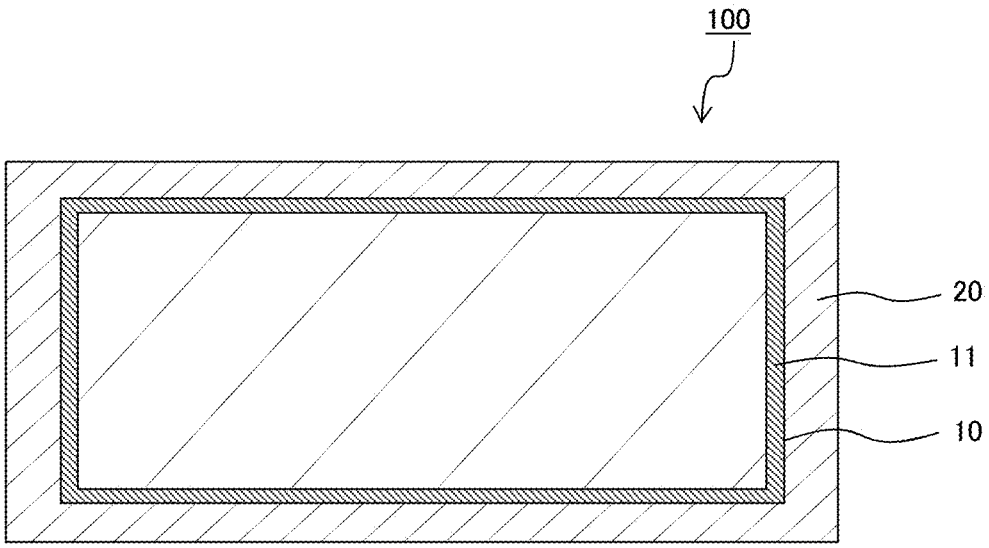
FIG. 1 is a structural view of a gold plate coated stainless material 100 according to the present embodiment.

The gold plate coated stainless material 100 according to the present embodiment is configured such that, as shown in FIG. 1, a gold plated layer 20 is formed on a stainless steel sheet 10 formed with a passivation film 11, and has a feature that the passivation film 11 of the stainless steel sheet 10 has a surface of which the Cr/O value is within a range of 0.05 to 0.2 and the Cr/Fe value is within a range of 0.5 to 0.8 when measured by Auger electron spectroscopy analysis.

<Stainless Steel Sheet 10>

The stainless steel sheet 10 to be a substrate of the gold plate coated stainless material 100 according to the present embodiment is not particularly limited. Examples of the stainless steel sheet 10 include those made of stainless steel material, such as SUS316L and SUS304. Various types of stainless steel sheets may be mentioned, such as martensite-based, ferrite-based and austenite-based ones, among which austenite-based stainless steel sheets may be preferred. The shape and form of the stainless steel sheet 10 are not particularly limited, and may be appropriately selected depending on the use. For example, the stainless steel sheet 10 may be used after being worked into a necessary shape or form depending on its use, such as a conductive metal component worked into a linear form or a plate or sheet-like form, a conductive member obtained by working a plate or sheet into an irregular form, and an electronic device component worked into a spring-like or tubular form. The thickness (such as diameter and sheet or plate thickness) of the stainless steel sheet 10 is also not particularly limited, and may be appropriately selected depending on the use.

As shown in FIG. 1, the stainless steel sheet 10 is formed with the passivation film 11 at the surface. When measured by Auger electron spectroscopy analysis, the surface of the passivation film 11 has a certain Cr/O value (molar ratio of Cr/O) and a certain Cr/Fe value (molar ratio of Cr/Fe), which range as follows. That is, the Cr/O value is within a range of 0.05 to 0.2 and may preferably be within a range of 0.05 to 0.15. The Cr/Fe value is within a range of 0.5 to 0.8 and may preferably be within a range of 0.5 to 0.7.

According to the feature of the present embodiment that the Cr/O value and Cr/Fe value when measured by Auger electron spectroscopy analysis are controlled within the above ranges on the surface of the passivation film 11 formed with the stainless steel sheet 10, the gold plated layer 20 to be formed on the passivation film 11 can have an improved coverage (ratio of an area covered by the gold plated layer 20 to the surface of the passivation film 11 on which the gold plated layer 20 is formed) and an excellent interfacial adhesion property.

In the present embodiment, the Cr/O value and Cr/Fe value can be measured by Auger electron spectroscopy analysis using the method below. First, a scanning-type Auger electron spectroscopy analyzer (AES) is used to measure the surface of the passivation film 11, and the atomic percentages of Cr, O, and Fe at the surface of the passivation film 11 are calculated. Five locations at the surface of the passivation film 11 are measured using a scanning-type Auger electron spectroscopy analyzer, and the obtained results may be averaged thereby to calculate the Cr/O value (at % of Cr/at % of O) and the Cr/Fe value (at % of Cr/at % of Fe). Among the obtained peaks by the measurement using a scanning-type Auger electron spectroscopy analyzer in the present embodiment, a peak given at 510 to 535 eV represents the peak of Cr, a peak given at 485 to 520 eV represents the peak of O, and a peak given at 570 to 600 eV represents the peak of Fe. The atomic percentages of Cr, O, and Fe are to be measured when the sum of Cr, O, and Fe is 100 at %.

In the present embodiment, the method of forming the passivation film 11 at the surface of the stainless steel sheet 10 is not particularly limited. Examples of the method include a method of immersing a stainless steel material, such as SUS316L as described above, which constitutes the stainless steel sheet 10, into a sulfuric acid aqueous solution.

When a stainless steel material is immersed in a sulfuric acid aqueous solution to form the passivation film 11, the sulfuric acid concentration in the sulfuric acid aqueous solution may preferably be 20 to 25 vol %. The temperature when immersing the stainless steel material may preferably be 50° C. to 70° C., and more preferably 60° C. to 70° C. The time for the stainless steel material to be immersed in the sulfuric acid aqueous solution may preferably be 5 to 600 seconds, and more preferably 5 to 300 seconds.

In particular, in the present embodiment, when a stainless steel sheet is immersed in a sulfuric acid aqueous solution having a sulfuric acid concentration x [vol %] ($20 \le x \le 25$), it is preferred to satisfy Expression (1) below:

$$0.6\times10^6 \le x^2\cdot(y-40)^2\sqrt{z} \le 3.0\times10^6 \quad (1)$$

where y represents an immersing temperature [° C.], and z represents an immersion time [seconds].

According to the feature of the present embodiment that the sulfuric acid concentration x [vol %], temperature y [° C.], and immersion time z [seconds] satisfy the above relationship of Expression (1) when the stainless steel material is immersed in the sulfuric acid aqueous solution to form the passivation film 11, it is possible to remove an oxide film formed intrinsically on the surface of the stainless steel material and to form, on the stainless steel material, the passivation film 11 having the surface of which the Cr/O value and Cr/Fe value are controlled within the above-described ranges when measured by Auger electron spectroscopy analysis.

<Gold Plated Layer 20>

The gold plated layer 20 is a layer that is formed by performing gold plating on the passivation film 11 of the stainless steel sheet 10. The plating method of forming the gold plated layer 20 is not particularly limited, but it is preferred to form the gold plated layer 20 by electroless plating.

The coverage of the gold plated layer 20, i.e., the ratio of an area covered by the gold plated layer 20 to the surface of the passivation film 11 on which the gold plated layer 20 is formed, may preferably be 95% or more. According to the feature that the coverage of the gold plated layer 20 is 95% or more, pinholes in the gold plated layer 20 can be reduced thereby to prevent the delamination of the gold plated layer 20 triggered from such pinholes and to further improve the corrosion resistance and conductivity of the gold plate coated stainless material 100 obtained.

The thickness of the gold plated layer 20 may preferably be 2 to 20 nm, and more preferably 2 to 5 nm. If the thickness of the gold plated layer 20 is unduly thin, the gold plated layer 20 will not be uniformly formed on the passivation film 11 of the stainless steel sheet 10, so that the corrosion resistance and conductivity may possibly deteriorate when the gold plated layer 20 is used as a part of the gold plate coated stainless material 100. On the other hand, an unduly thick thickness of the gold plated layer 20 may lead to disadvantages in cost.

In the above manner, the gold plate coated stainless material 100 can be obtained by performing gold plating to form the gold plated layer 20 on the passivation film 11 of the stainless steel sheet 10. According to the gold plate coated stainless material 100 of the present embodiment, as described above, the passivation film 11 formed on the stainless steel sheet 10 has the surface of which the Cr/O value and Cr/Fe value are controlled within the above ranges when measured by Auger electron spectroscopy analysis, and it is thereby possible to improve the coverage and interfacial adhesion property of the gold plated layer 20 formed on such a passivation film 11. Thus, the gold plate coated stainless material 100 of the present embodiment has improved coverage and interfacial adhesion property of the gold plated layer 20 even when reducing the thickness of the gold plated layer 20 at the surface. This allows the gold plate coated stainless material 100 to be excellent in corrosion resistance and conductivity and advantageous in cost, and the gold plate coated stainless material 100 may be suitably used as an electrical contact material such as used for connectors, switches or printed wiring boards.

As a method of producing a gold plate coated stainless material formed with a gold plated layer at the surface, there has conventionally been used a method of forming a gold plated layer by performing a gold plating process directly on a stainless steel sheet. In such a method, however, if the gold plated layer is formed to be thin, the coverage of the gold plated layer to the stainless steel sheet will be reduced to cause the stainless steel sheet to readily corrode. If, on the other hand, the gold plated layer is formed to be thick, a large amount of expensive gold will have to be used, leading to disadvantages in cost, which may be problematic.

In contrast, according to the gold plate coated stainless material 100 of the present embodiment, the passivation film 11 formed on the stainless steel sheet 10 has the surface of which the Cr/O value and Cr/Fe value are controlled within the above ranges when measured by Auger electron spectroscopy analysis, and the gold plated layer 20 having excellent coverage and interfacial adhesion property can thereby be formed on the passivation film 11. According to the present embodiment, therefore, even when the thickness of the gold plated layer 20 is thin, the gold plate coated stainless material 100 obtained can have excellent corrosion resistance and conductivity and can be advantageous in cost.

In the present embodiment, when using a method of immersing a stainless steel material in a sulfuric acid aqueous solution as described above, the sulfuric acid concentration, immersing temperature, and immersion time are set to satisfy the above relationship of Expression (1), and it is thereby possible to form the passivation film 11 having the surface of which the Cr/O value and Cr/Fe value are controlled within the above ranges when measured by Auger electron spectroscopy analysis. This allows the gold plated layer 20 having excellent coverage and interfacial adhesion property to be formed on the passivation film 11.

The reason that such effects can be obtained by immersing a stainless steel material in a sulfuric acid aqueous solution is not necessarily apparent, but may be considered as follows. First, the surface of a stainless steel material is formed intrinsically with an oxide film having a large content ratio of Cr atoms. Immersing such a stainless steel material in a sulfuric acid aqueous solution under the above condition can allow the oxide film on the surface to be removed, thereby controlling the content ratio of Cr atoms, which will interfere with the interfacial adhesion of the gold plated layer 20, in the passivation film 11 to be formed. This appears to improve the coverage and interfacial adhesion property of the gold plated layer 20.

Figure 2:
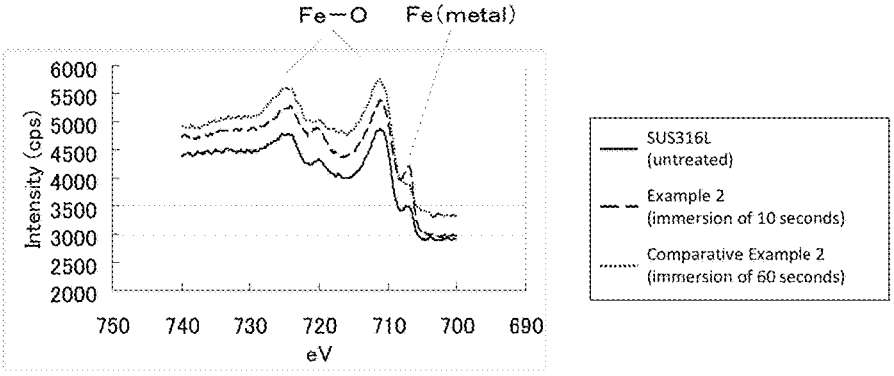
FIG. 2 is a set of graphs which show results when passivation films 11 of stainless steel sheets 10 obtained in the example and the comparative example were measured by X-ray photoelectron spectroscopy (XPS).
Figure 2:
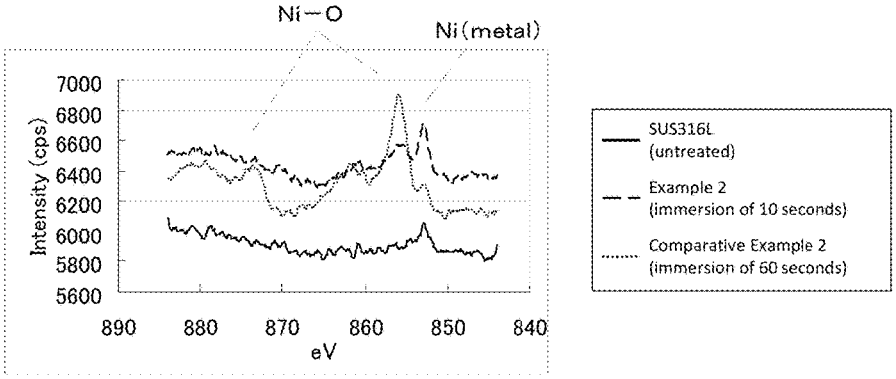
Figure 2:
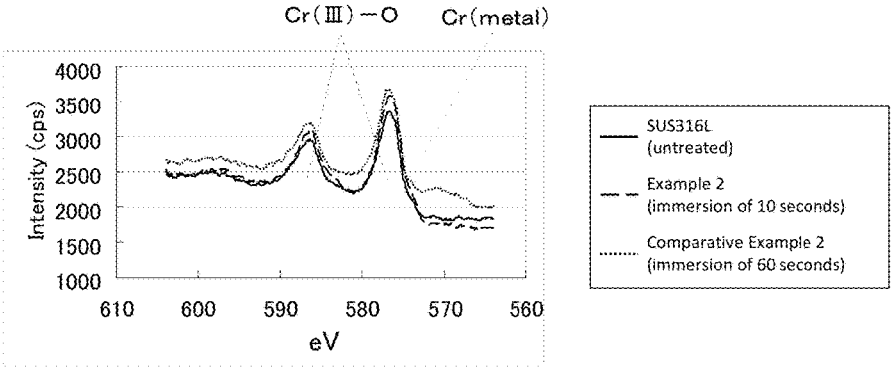
Figure 2:
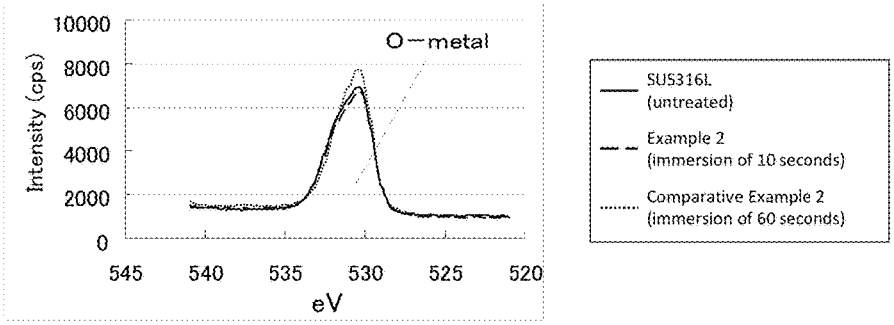

FIG. 2, which shows data of the example and comparative example to be described later, is a set of graphs showing measurement results by X-ray photoelectron spectroscopy (XPS) when austenite-based stainless steel materials (SUS316L) were immersed in a sulfuric acid aqueous solution having a sulfuric acid concentration of 25 vol % under a temperature of 70° C.

FIG. 2(A), FIG. 2(B), FIG. 2(C), and FIG. 2(D) of FIG. 2 show results when peaks of Fe2p, Ni2p, Cr2p, and O1s were measured, respectively. In each graph of FIG. 2(A) to FIG. 2(D), the measurement result of an untreated stainless steel material before being immersed in a sulfuric acid aqueous solution is indicated by a solid line, the measurement result after 10-second immersion in a sulfuric acid aqueous solution is indicated by a broken line, and the measurement result after 60-second immersion in a sulfuric acid aqueous solution is indicated by a dotted line.

In FIG. 2(A), the peaks near 712 eV and 725 eV represent an oxide of iron (Fe—O), and the peak near 707 eV represents an elementary substance of iron (Fe (metal)). In FIG. 2(B), the peaks near 874 eV and 856 eV represent an oxide of nickel (Ni—O), and the peak near 853.5 eV represents an elementary substance of nickel (Ni (metal)). In FIG. 2(C), the peaks near 586 eV and 577 eV represent an oxide of chromium (Cr(III)—O), and the peak near 574 eV represents an elementary substance of chromium (Cr (metal)). In FIG. 2(D), the peak near 531 eV represents oxygen that is bonded with a metal, such as iron, nickel, and chromium (O-metal).

As shown in FIG. 2(A), when a stainless steel material is immersed in a sulfuric acid aqueous solution having a sulfuric acid concentration of 25 vol % under 70° C. for 10 seconds, the peak of Fe (metal) near 707 eV is larger than that of the untreated state without immersion in a sulfuric acid aqueous solution. It can thus be confirmed that immersing a stainless steel material in a sulfuric acid aqueous solution allows the oxide film, which contains a large amount of Cr atoms, to be appropriately removed from the stainless steel sheet, so that an active elementary substance of iron (Fe (metal)) is exposed at the surface of the passivation film 11 formed.

Here, when a stainless steel material is immersed in a sulfuric acid aqueous solution, if the sulfuric acid concentration is unduly low, if the immersion temperature is unduly low, or if the immersion time is unduly short, the oxide film, which contains a large amount of Cr atoms, cannot be completely removed from the stainless steel sheet, and the content ratio of Cr atoms at the outermost surface will be large (i.e., the above Cr/O value and Cr/Fe value will be excessively high). This may lead to insufficient exposure of an elementary substance of iron (Fe (metal)) at the surface of the passivation film 11 formed, thereby to deteriorate the coverage and interfacial adhesion property of the gold plated layer 20.

The above-described FIG. 2(A) to FIG. 2(D) show examples in which, when immersing a stainless steel material in a sulfuric acid aqueous solution, only the immersion time is varied while fixing the sulfuric acid concentration at 25 vol % and the temperature at 70° C. In such examples, as shown in the graph of FIG. 2(A), when the immersing time is set at 60 seconds, the peak of Fe (metal) near 707 eV tends to be smaller than that of the untreated state due to a reduced ratio of an elementary substance of iron (Fe(metal)) at the surface of the passivation film 11.

According to the present embodiment, however, even when the immersion time is set at 60 seconds or more, the relationship of the sulfuric acid concentration, temperature, and immersion time may satisfy the above Expression (1) thereby to suppress the depression of the peak of Fe (metal) at the surface of the passivation film 11 formed. This allows the value of Fe (metal)/Fe (total) to be within a certain range, which can appropriately improve the coverage and interfacial adhesion property of the gold plated layer 20 formed on the passivation film 11.

In the present embodiment, when immersing a stainless steel material in a sulfuric acid aqueous solution, the ratio (Fe (metal)/Fe (total)) of an elementary substance of iron (Fe (metal) to the total amount of Fe atoms (Fe (total)) may preferably be 14% or more, and more preferably 18% or more, at the surface of the passivation film 11 formed. According to the feature that the value of Fe (metal)/Fe (total) is 14% or more, an active elementary substance of iron can be appropriately exposed at the surface of the passivation film 11 thereby to further improve the coverage and interfacial adhesion property of the gold plated layer 20 formed on such a passivation film 11.

Examples of a method of obtaining the value of Fe (metal)/Fe (total) include a method based on the above-described measurement results by X-ray photoelectron spectroscopy (XPS) as shown in FIG. 2(A), for example, in which after the background is subtracted from the measurement results, the value of Fe (metal)/Fe (total) is obtained by calculating the ratio of an integrated value of the peak of an elementary substance of iron (Fe (metal)) to the sum of an integrated value of the peaks of an oxide of iron (Fe—O) and the integrated value of the peak of an elementary substance of iron (Fe (metal)).

Examples of a method of allowing the value of Fe (metal)/Fe (total) to be within the above range at the surface of the passivation film 11 include a method of causing the sulfuric acid concentration, temperature, and immersion time when immersing the stainless steel material in a sulfuric acid aqueous solution to have a relationship that satisfies the above Expression (1).

In the present embodiment, when using a nickel-containing stainless steel material, such as an austenite-based stainless steel material, and immersing the stainless steel material in a sulfuric acid aqueous solution, the ratio (Ni (metal)/Ni (total)) of an elementary substance of nickel (Ni (metal) to the total amount of Ni atoms (Ni (total)) may preferably be 18% or more, and more preferably 25% or more, at the surface of the passivation film 11 formed. According to the feature that the value of Ni (metal)/Ni (total) is 18% or more, the ratio of an oxide of nickel, which has a property of being very brittle, can be reduced at the surface of the passivation film 11 thereby to further improve the coverage and interfacial adhesion property of the gold plated layer 20.

This will be described in more detail. When a stainless steel material is immersed in a sulfuric acid aqueous solution, if the sulfuric acid concentration is unduly high, if the temperature is unduly high, or if the immersion time is unduly long, the stainless steel sheet will be eroded by the sulfuric acid aqueous solution after the formation of the passivation film 11 thereby to lead to preferential dissolution of Fe from the stainless steel sheet. Consequently, the content ratio of Cr atoms will relatively increase at the surface of the passivation film 11 (i.e., the above Cr/O value and Cr/Fe value will be excessively high), and an oxide of nickel (Ni—O) will be formed. Thus, due to the effects of Cr and the oxide of nickel, the coverage and interfacial adhesion property of the gold plated layer 20 formed may deteriorate. Here, since the oxide of nickel has a property of being very brittle, if the gold plated layer 20 is formed on a part of the passivation film 11 that contains a large amount of the oxide of nickel, the oxide of nickel itself will delaminate from the stainless steel sheet 10. This may deteriorate the coverage and interfacial adhesion property of the gold plated layer 20.

In contrast, according to the feature of the present embodiment that the Ni (metal)/Ni (total) is within the above range at the surface of the passivation film 11, the ratio of an elementary substance of nickel can be increased to reduce the ratio of an oxide of nickel having a property of being very brittle, thereby to further improve the coverage and interfacial adhesion property of the gold plated layer 20.

Examples of a method of obtaining the value of Ni (metal)/Ni (total) include a method based on the above-described measurement results by X-ray photoelectron spectroscopy (XPS) as shown in FIG. 2(B), for example, in which after the background is subtracted from the measurement results, the value of Ni (metal)/Ni (total) is obtained by calculating the ratio of an integrated value of the peak of an elementary substance of nickel (Ni (metal)) to the sum of an integrated value of the peaks of an oxide of nickel (Ni—O) and the integrated value of the peak of an elementary substance of nickel (Ni (metal)).

Examples of a method of allowing the value of Ni (metal)/Ni (total) to be within the above range at the surface of the passivation film 11 include a method of causing the sulfuric acid concentration, temperature, and immersion time when immersing the stainless steel material in a sulfuric acid aqueous solution to have a relationship that satisfies the above Expression (1).

In the present embodiment, when immersing a stainless steel material in an sulfuric acid aqueous solution, the surface roughness of the passivation film 11 formed may preferably be 0.015 μm or more, and more preferably 0.018 μm or more, as an arithmetic average roughness Ra. According to the feature that the surface roughness of the passivation film 11 is within the above range, the coverage and interfacial adhesion property of the gold plated layer 20 can be further improved due to an anchor effect when forming the gold plated layer 20 on the passivation film 11.

Examples of a method of allowing the surface roughness of the passivation film 11 to be within the above range include a method of elongating the immersion time when immersing the stainless steel material in a sulfuric acid aqueous solution. In this case, as the immersion time increases, the surface roughness of the passivation film 11 formed increases. Likewise, also as the sulfuric acid concentration or temperature increases when immersing the stainless steel material in a sulfuric acid aqueous solution, the surface roughness of the passivation film 11 formed increases to further improve the coverage and interfacial adhesion property of the gold plated layer 20.

In the present embodiment, the gold plate coated stainless material 100 can be used as a separator for fuel cells. Such a separator for fuel cells is used as a member of a fuel cell that constitutes a fuel cell stack, and has a function to supply an electrode with fuel gas or air through gas flow channels and a function to collect electrons generated at the electrode. When the gold plate coated stainless material 100 is used as a separator for fuel cells, it is preferred to use a stainless steel sheet 10 of which the surface is preliminarily formed with irregularities (gas flow channels) that function as flow channels for fuel gas or air. The method of forming such gas flow channels is not particularly limited, but a method of forming the gas flow channels by press working may be mentioned, for example.

In general, a separator for fuel cells is exposed to an environment of high temperature and acidic atmosphere in the fuel cells. Therefore, when a stainless steel sheet formed with a gold plated layer at the surface is used as a separator for fuel cells, if the coverage of the gold plated layer at the surface is low, corrosion of the stainless steel sheet will progress rapidly. This may result in a problem in that the electrical resistance value increases due to the corrosion product generated on the surface of the stainless steel sheet to deteriorate the function as a separator for fuel cells, i.e., the function of collecting electrons generated at the electrode.

In contrast, the gold plate coated stainless material 100 according to the present embodiment is formed with the gold plated layer 20 having excellent coverage and interfacial adhesion property as described above, and can be suitably used as such a separator for fuel cells.

EXAMPLES

Hereinafter, the present invention will be more specifically described with reference to examples, but the present invention is not limited to these examples.

The definition and evaluation method for each property is as follows.

<Measurement of Cr/O Value and Cr/Fe Value>

A field emission Auger microprobe (AES) (model number: JAMP-9500F, available from JEOL Ltd.) was used for a stainless steel sheet 10 formed with a passivation film 11 at the surface to measure the atomic percentages of Cr, O, and Fe at five locations, and the obtained results were averaged thereby to obtain the Cr/O value (at % of Cr/at % of O) and the Cr/Fe value (at % of Cr/at % of Fe). The measurement of the Cr/O value and Cr/Fe value was performed only for Examples 1, 2, and 4 and Comparative Examples 1, 2, and 26 of the examples and the comparative examples to be described later.

<XRD Analysis>

An X-ray analytical instrumentation (model number: RINT-2500, available from Rigaku Corporation) was used for the surface of a stainless steel sheet 10 formed with a passivation film 11 at the surface to identify crystals contained in the surface of the stainless steel sheet 10. The XRD analysis was performed only for Example 3 of the examples and the comparative examples to be described later. For comparison, the XRD analysis was also performed in a similar manner for a stainless steel material (SUS316L) without being immersed in a sulfuric acid aqueous solution.

<XPS Measurement>

An X-ray photoelectron spectrometer (model number: VersaProbe II, available from ULVAC-PHI, Inc) was used for the surface of a passivation film 11 formed on a stainless steel sheet 10 to perform XPS measurement by measuring respective peaks of Fe2p, Ni2p, Cr2p, and O1s. The XPS measurement was performed only for Example 2 and Comparative Example 2 of the examples and the comparative examples to be described later. For comparison, the XPS measurement was also performed in a similar manner for a stainless steel material (SUS316L) without being immersed in a sulfuric acid aqueous solution.

<Measurement of Surface Roughness>

A laser microscope (LEXT OLS3500 available from Olympus Corporation) was used for the surface of a passivation film 11 formed on a stainless steel sheet 10 to measure the arithmetic average roughness Ra in accordance with JIS B 0601: 1994. The measurement of surface roughness was performed only for Examples 1, 2, and 4 and Comparative Examples 1 and 2 of the examples and the comparative examples to be described later. For comparison, the measurement of surface roughness was also performed in a similar manner for a stainless steel material (SUS316L) without being immersed in a sulfuric acid aqueous solution.

<Observation of Cross-Section>

After forming a carbon deposited film by carbon vapor deposition on a stainless steel sheet 10 formed with a passivation film 11 at the surface, the stainless steel sheet 10 was cut to expose a cross-section, and a cross-sectional image was obtained by measuring the exposed cross-section using a scanning-type electron microscope (model number: HD-2700, available from Hitachi High-Technologies Corporation). The observation of cross-section was performed only for Example 2 and Comparative Example 2 of the examples and the comparative examples to be described later. For comparison, the observation of cross-section was also performed in a similar manner for a stainless steel material (SUS316L) without being immersed in a sulfuric acid aqueous solution.

<Measurement of Electron Beam Diffraction Pattern>

A transmission-type electron microscope (model number: HF-2000, available from Hitachi High-Technologies Corporation) was used to measure the surface of a passivation film 11 formed on a stainless steel sheet 10, and an electron beam diffraction pattern was obtained. The measurement of electron beam diffraction pattern was performed only for Example 2 and Comparative Example 2 of the examples and the comparative examples to be described later. For comparison, the measurement of electron beam diffraction pattern was also performed in a similar manner for a stainless steel material (SUS316L) without being immersed in a sulfuric acid aqueous solution.

<Evaluation of Plating Property>

For a gold plate coated stainless material 100 obtained by forming a gold plated layer 20 on a stainless steel sheet 10 formed with a passivation film 11, plating property of the gold plated layer 20 was evaluated. The evaluation of plating property was specifically performed such that the presence or absence of Au at the surface of the gold plate coated stainless material 100 was detected using a fluorescent X-ray spectrometer (model number: ZSX100e, available from Rigaku Corporation), and evaluation was performed in accordance with the criteria as below. The evaluation of plating property was performed for all of the examples and the comparative examples to be described later.

○: Au was detected at the surface of the gold plate coated stainless material 100.

x: Au was not detected at the surface of the gold plate coated stainless material 100.

<Evaluation of Interfacial Adhesion Property>

For a gold plate coated stainless material 100, the interfacial adhesion property of a gold plated layer 20 was evaluated. The evaluation of the interfacial adhesion property was specifically performed through: conducting a peel test by applying a pressure sensitive adhesive tape (NIC- ETACK powerfully adhesive tape, available from Nichiban Co., Ltd.) to the gold plated layer 20 of the gold plate coated stainless material 100 and then peeling off the tape; and thereafter observing the delamination state of the gold plated layer 20, and the evaluation was performed in accordance with the criteria as below. The evaluation of the interfacial adhesion property was performed for all of the examples and the comparative examples to be described later.

○: Delamination of the gold plated layer 20 was not confirmed.

Δ: The gold plated layer 20 was delaminated with a part of the pressure sensitive adhesive tape.

x: The gold plated layer 20 was delaminated with the whole surface of the pressure sensitive adhesive tape.

ND: The gold plated layer 20 was not formed, and evaluation was impossible.

<Measurement of Coverage of Gold Plated Layer 20>

The surface of a gold plate coated stainless material 100 was observed using a scanning-type electron microscope SEM (S-4800 available from Hitachi High-Technologies Corporation), and the coverage of a gold plated layer 20 was measured based on the obtained SEM image. Measurement of the coverage of the gold plated layer 20 was performed by image processing, i.e., binarizing the above SEM image using a brightness threshold determined such that the defects such as pinholes in the gold plated layer 20 would be able to be specified, and thereafter, based on the obtained image by the image processing, calculating the ratio of an area formed with the gold plated layer 20. The measurement of coverage of the gold plated layer 20 was performed only for Example 4 of the examples and the comparative examples to be described later.

<Evaluation of Corrosion Resistance>

Evaluation of the corrosion resistance was performed through: masking a gold plate coated stainless material 100 with a polyimide tape to expose a surface area of 35 mm longitudinal and 20 mm lateral; immersing the gold plate coated stainless material 100 in a sulfuric acid aqueous solution of pH of 1.0 and a temperature of 90° C. for 100 hours; thereafter taking out the gold plate coated stainless material 100; and measuring a mass concentration (g/L) of ions (Fe, Cr, Mo, and Ni) dissolved from the gold plate coated stainless material 100 into the sulfuric acid aqueous solution using an inductively coupled plasma emission spectrometer (ICPE-9000 available from SHIMADZU CORPORATION). The evaluation of corrosion resistance was performed only for Example 14 of the examples and the comparative examples to be described later. For comparison, the evaluation of corrosion resistance was also performed in a similar manner for a stainless steel material (SUS316L) without being immersed in a sulfuric acid aqueous solution.

<Measurement of Contact Resistance Value>

Figure 10:
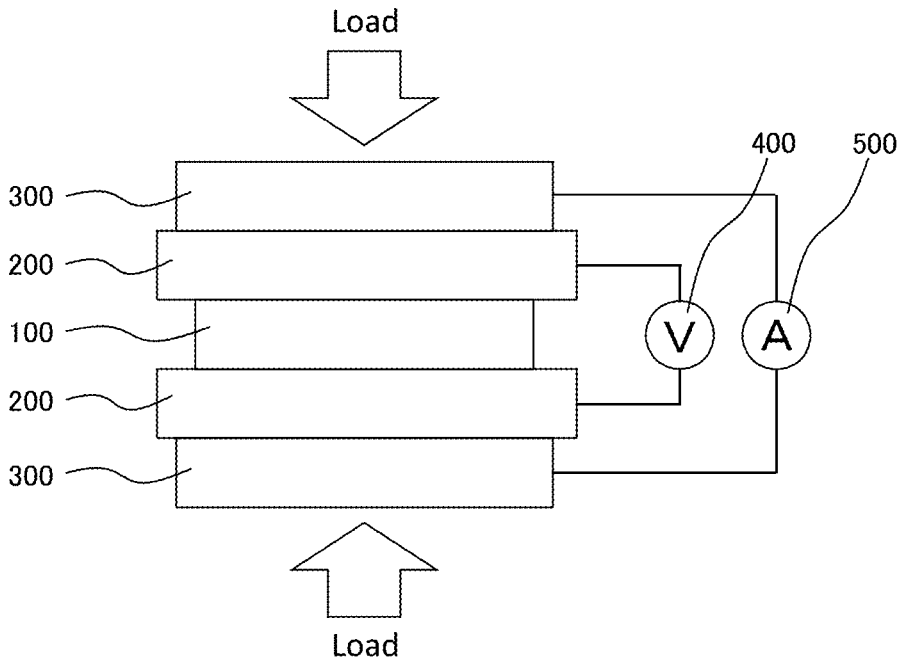
FIG. 10 is a diagram for explaining a method of measuring a contact resistance of gold plate coated stainless materials 100 obtained in the examples.

For a gold plate coated stainless material 100, measurement of the contact resistance value was performed using a measurement system as shown in FIG. 10. The measurement system shown in FIG. 10 is configured of: the gold plate coated stainless material 100; carbon cloths 200, which are used as diffusion layers for fuel cells; gold plate coated copper electrodes 300; a voltmeter 400; and an ammeter 500. Specifically, at the time of measurement of the contact resistance value, the gold plate coated stainless material 100 was first worked into a size of width of 20 mm, length of 20 mm and thickness of 1.27 mm and fixed by being interposed between the gold plate coated copper electrodes 300 via the carbon cloths 200 (part number: TGP-H-090, available from Toray Industries, Inc), and the measurement system was thus obtained as shown in FIG. 10. Then, the contact resistance values between the upper and lower carbon cloths 200 sandwiching the test piece were measured using an ohm meter (Milli-Ohm HiTESTER 3540 available from HIOKI E.E. CORPORATION) while applying a constant load to the gold plate coated copper electrodes 300. The measurement of contact resistance value was performed only for Example 14 of the examples and the comparative examples to be described later. For comparison, the measurement of contact resistance value was also performed in a similar manner for a stainless steel material (SUS316L) without being immersed in a sulfuric acid aqueous solution, after working the stainless steel material into a size of width of 20 mm, length of 20 mm and thickness of 1.0 mm.

Example 1

First, a stainless steel material (SUS316L) for forming a stainless steel sheet 10 was prepared. Then, the prepared stainless steel material was immersed in a sulfuric acid aqueous solution of a sulfuric acid concentration of 25 vol % under a condition of a temperature of 70° C. and an immersion time of 5 seconds, and the stainless steel sheet 10 formed with a passivation film 11 on the surface was thus obtained.

For the stainless steel sheet 10 formed with such a passivation film 11, measurement of the Cr/O value and Cr/Fe value and measurement of the surface roughness were performed in accordance with the above-described methods. Results are listed in Table 1 and shown in FIGS. 3 and 4. Table 1 also presents results of calculating the term in the above Expression (1) relating to variables, i.e., the sulfuric acid concentration x [vol %], temperature y [° C.], and immersion time z [seconds] when immersing the stainless steel material in the sulfuric acid aqueous solution.

Figure 3:
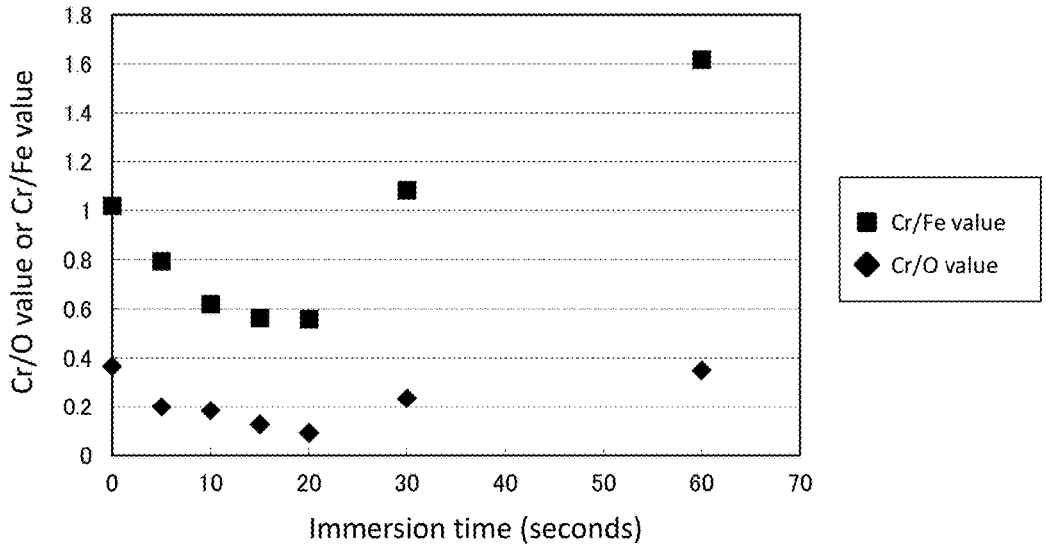
FIG. 3 is a graph which shows results when the Cr/O values and Cr/Fe values at the surfaces of passivation films 11 of stainless steel sheets 10 obtained in the examples and the comparative examples were measured by Auger electron spectroscopy analysis.

FIG. 3 is a graph showing the measurement results of the Cr/O values and Cr/Fe values, in which the horizontal axis represents the immersion time when immersing the stainless steel material in the sulfuric acid aqueous solution, and the vertical axis represents the Cr/O value and Cr/Fe value measured by a scanning-type Auger electron spectroscopy analyzer (AES).

Figure 4:
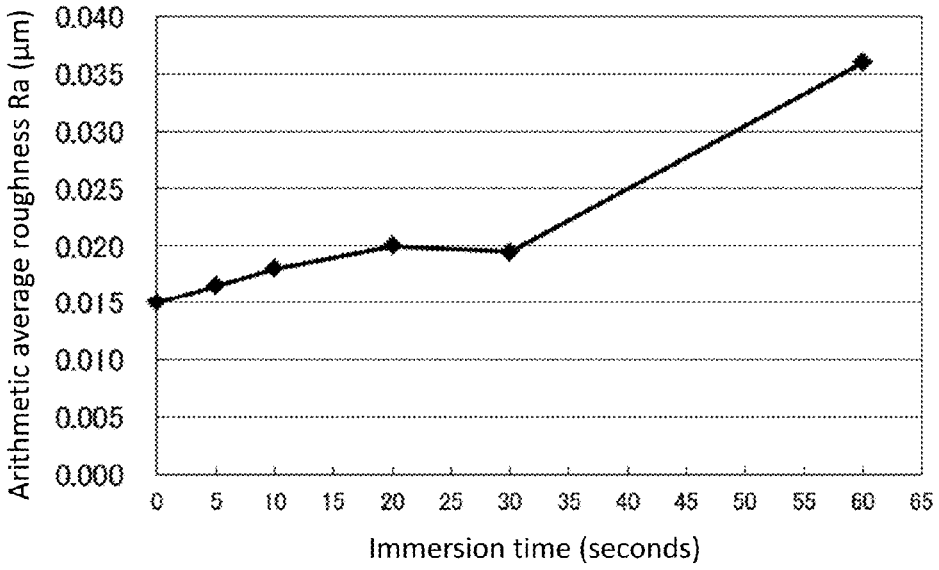
FIG. 4 is a diagram which shows results when the surface roughnesses of passivation films 11 of stainless steel sheets 10 obtained in the examples and the comparative examples were measured.

FIG. 4 is a graph showing the measurement results of the surface roughness, in which the horizontal axis represents the immersion time when immersing the stainless steel material in the sulfuric acid aqueous solution, and the vertical axis represents the arithmetic average roughness Ra.

Subsequently, for the stainless steel sheet 10 formed with the passivation film 11, an electroless gold plating process was performed using an electroless gold plating bath (product name: FLASH GOLD NC, available from Okuno Chemical Industries Co., Ltd.) under a condition of 70° C. and 5 minutes to form a gold plated layer 20 having a thickness of about 23 nm on the passivation film 11, and a gold plate coated stainless material 100 was thus obtained.

Thereafter, for the gold plate coated stainless material 100 thus obtained, evaluation of the plating property and evaluation of the interfacial adhesion property were performed in accordance with the above-described methods. Results are listed in Table 1.

Examples 2 to 13

Gold plate coated stainless materials 100 were produced in the same manner as in Example 1 except that the concentration, temperature, and immersion time when immersing the stainless steel material in the sulfuric acid aqueous solution were set in accordance with those as listed in Table 1, and measurement of the Cr/O value and Cr/Fe value, XRD analysis, XPS measurement, measurement of the surface roughness, observation of the cross-section, measurement of the electron beam diffraction pattern, evaluation of the plating property, and evaluation of the interfacial adhesion property were performed in accordance with the above-described methods. Results are listed in Table 1 and shown in FIGS. 2 to 7.

FIG. 2 shows results when respective peaks of Fe2p, Ni2p, Cr2p, and O1s were measured by XPS measurement for the surfaces of the passivation films 11 formed on the stainless steel sheets 10. Here, FIG. 2(A), FIG. 2(B), FIG. 2(C), and FIG. 2(D) show results when peaks of Fe2p, Ni2p, Cr2p, and O1s were measured, respectively. In each graph of FIG. 2(A) to FIG. 2(D), the result of Example 2 is indicated by a broken line, the result of Comparative Example 2 to be described later is indicated by a dotted line, and the result of a stainless steel material (SUS316L) without being immersed in a sulfuric acid aqueous solution is indicated by a solid line.

Figure 5:
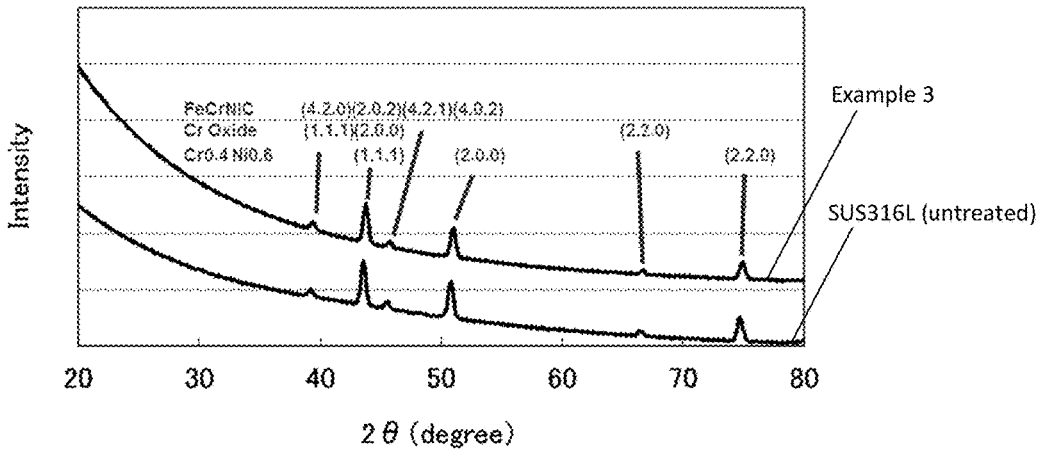
FIG. 5 is a graph which shows results when XRD analysis was performed using an X-ray analytical instrumentation for a passivation film 11 of a stainless steel sheet 10 obtained in the example.

FIG. 5 is a graph showing results of XRD analysis, in which the horizontal axis represents a diffraction angle, and the vertical axis represents the intensity of diffracted X-rays detected by an X-ray analytical instrumentation. In the graph of FIG. 5, each peak is indicated together with information about a crystal that originates the peak and about crystal plane orientation thereof. In the graph of FIG. 5, FeCrNiC represents a crystal of FeCrNiC compound, CrOxide represents a crystal of chromium oxide, and Cr0.4Ni0.6 represents a crystal of CrNi alloy in which the Cr:Ni ratio is 0.4:0.6 (at %).

Figure 7:
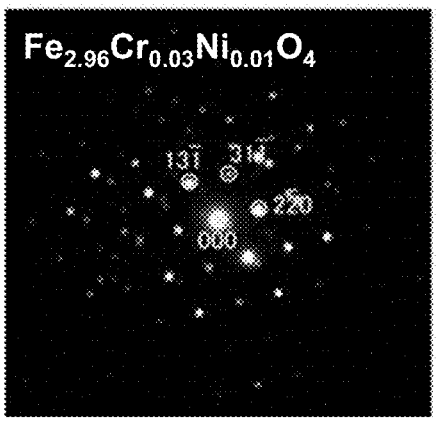
FIG. 7 is a set of diagrams of electron beam diffraction patterns of passivation films 11 of stainless steel sheets 10 obtained in the example and the comparative example.
Figure 7:
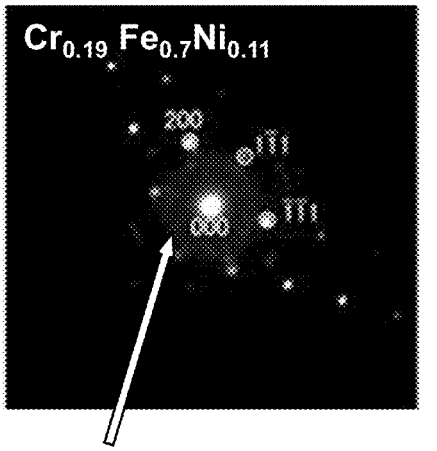
Figure 7:
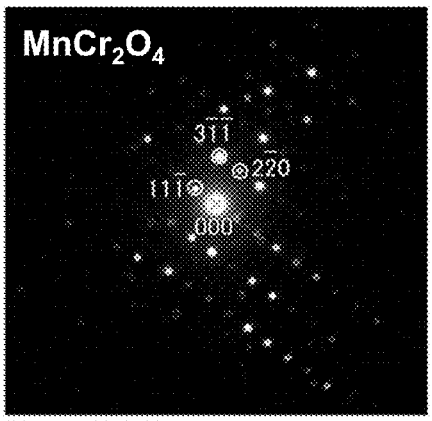

FIG. 7 shows results of measuring electron beam diffraction patterns at the surfaces of the passivation films 11 formed on the stainless steel sheets 10. FIG. 7(A) shows the result of Example 2, FIG. 7(B) shows the result of Comparative Example 2 to be described later, and FIG. 7(C) shows the result of a stainless steel material (SUS316L) without being immersed in a sulfuric acid aqueous solution. Here, FIG. 7(A) shows the measurement result of a diffraction pattern from a crystal (element ratio: $Fe_{2.96}Cr_{0.03}Ni_{0.01}O_4$) which contains a relatively large amount of an elementary substance of iron. Likewise, FIG. 7(B) shows the measurement result of a diffraction pattern from a crystal (element ratio: $Cr_{0.19}Fe_{0.7}Ni_{0.11}$) which contains a relatively large amount of an oxide of nickel, and FIG. 7(C) shows the measurement result of a diffraction pattern from a crystal ($MnCr_2O_4$) of an oxide of chromium.

Comparative Examples 1 to 9

Gold plate coated stainless materials 100 were produced in the same manner as in Example 1 except that the concentration of sulfuric acid aqueous solution and immersion time when immersing the stainless steel material in the sulfuric acid aqueous solution were set in accordance with those as listed in Table 1, and measurement of the Cr/O value and Cr/Fe value, XRD analysis, XPS measurement, measurement of the surface roughness, observation of the cross-section, measurement of the electron beam diffraction pattern, evaluation of the plating property, and evaluation of the interfacial adhesion property were performed in accordance with the above-described methods. Results are listed in Table 1 and shown in FIGS. 2 to 4, 6, and 7.

TABLE 1

| | | | | | | | | Gold plated layer | |
|---|---|---|---|---|---|---|---|---|---|
| | Type of acid | Concentration [vol %] | Temperature [° C.] | Immersion time [seconds] | $x^2 \cdot (y-40)^2 \sqrt{2}$ Calculated value ($\times 10^6$) | Passivation film Cr/O value | Passivation film Cr/Fe value | Plating property | Interfacial adhesion property |
| Example 1 | Sulfuric acid | 25 | 70 | 5 | 1.26 | 0.1987 | 0.7918 | ○ | ○ |
| Example 2 | | | | 10 | 1.78 | 0.1833 | 0.8178 | ○ | ○ |
| Example 3 | | | | 15 | 2.18 | 0.1254 | 0.5631 | ○ | ○ |
| Example 4 | | | | 20 | 2.52 | 0.092 | 0.5577 | ○ | ○ |
| Example 5 | | | 60 | 120 | 2.74 | 0.1844 | 0.6674 | ○ | ○ |
| Example 6 | | | 50 | 180 | 0.84 | 0.1245 | 0.5817 | ○ | ○ |
| Example 7 | | | | 300 | 1.08 | — | — | ○ | ○ |
| Example 8 | | | | 600 | 1.53 | — | — | ○ | ○ |
| Example 9 | | 20 | 70 | 20 | 1.81 | — | — | ○ | ○ |
| Example 10 | | | | 40 | 2.28 | — | — | ○ | ○ |
| Example 11 | | | | 60 | 2.79 | 0.1423 | 0.5674 | ○ | ○ |
| Example 12 | | | 80 | 60 | 1.24 | — | — | ○ | ○ |
| Example 13 | | | 80 | 300 | 0.68 | 0.191 | 0.7222 | ○ | ○ |
| Comparative Example 1 | | 25 | 70 | 30 | 3.08 | 0.2338 | 1.082 | ○ | Δ |
| Comparative Example 2 | | | | 60 | 4.86 | 0.3487 | 1.6158 | ○ | x |
| Comparative Example 3 | | | | 300 | 9.74 | 0.4634 | 2.2461 | ○ | x |
| Comparative Example 4 | | 5 | | 30 | 0.12 | 0.3121 | 0.9572 | x | N.D. |
| Comparative Example 5 | | | | 60 | 0.17 | — | — | x | N.D. |
| Comparative Example 6 | | | | 300 | 0.39 | — | — | x | N.D. |
| Comparative Example 7 | | 10 | | 30 | 0.49 | — | — | x | N.D. |
| Comparative Example 8 | | | | 60 | 0.70 | — | — | x | N.D. |
| Comparative Example 9 | | | | 300 | 1.58 | 0.4624 | 1.2468 | x | N.D. |

Figure 6:
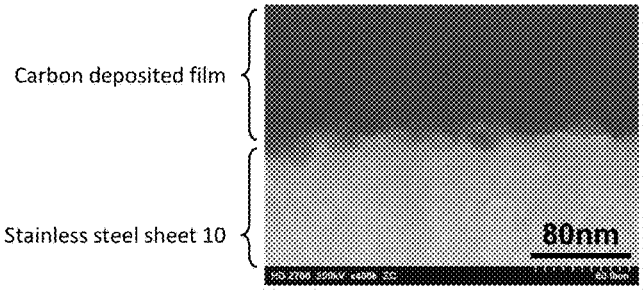
FIG. 6 is a set of cross-sectional images of passivation films 11 of stainless steel sheets 10 obtained in the example and the comparative example.
Figure 6:
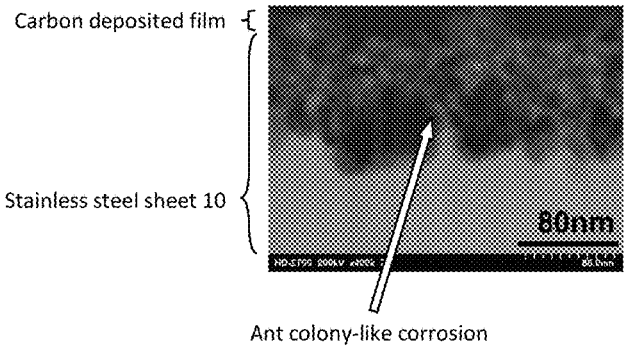
Figure 6:
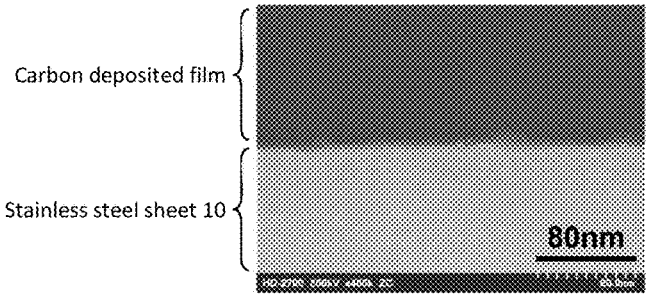

FIG. 6 is a set of diagrams showing results of observation of cross-sections in the stainless steel sheets 10 formed with the passivation films 11 at the surfaces. FIG. 6(A) shows the result of Example 2, FIG. 6(B) shows the result of Comparative Example 2 to be described later, and FIG. 6(C) shows the result of a stainless steel material (SUS316L) without being immersed in a sulfuric acid aqueous solution.

Comparative Examples 10 to 22

Gold plate coated stainless materials 100 were produced in the same manner as in Example 1 except that a process of immersing the stainless steel material in a hydrochloric acid was performed as substitute for the process of immersing the stainless steel material in a sulfuric acid aqueous solution and that the concentration of hydrochloric acid, temperature, and immersion time when immersing the stainless steel material in the hydrochloric acid were set in accordance with those as listed in Table 2, and evaluation of the plating property and evaluation of the interfacial adhesion property were performed in accordance with the above-described methods. Results are listed in Table 2.

Comparative Examples 23 to 25

Gold plate coated stainless materials 100 were produced in the same manner as in Example 1 except that a process of immersing the stainless steel material in an acidic aqueous solution of a sulfuric acid concentration of 6 vol % and a phosphoric acid concentration of 4 vol % was performed as substitute for the process of immersing the stainless steel material in a sulfuric acid aqueous solution and that the temperature and immersion time when immersing the stainless steel material in the acidic aqueous solution were set in accordance with those as listed in Table 2, and evaluation of the plating property and evaluation of the interfacial adhesion property were performed in accordance with the above-described methods. Results are listed in Table 2.

Comparative Example 26

A gold plate coated stainless material 100 was produced in the same manner as in Example 1 except that a gold plated layer was formed directly on the stainless steel sheet 10 without immersing the stainless steel material in a sulfuric acid aqueous solution, and measurement of the Cr/O value and Cr/Fe value, evaluation of the plating property, and evaluation of the interfacial adhesion property were performed in accordance with the above-described methods. Results are listed in Table 2 and shown in FIG. 3.

As shown in FIG. 3, it has been confirmed that each of Examples 1, 2, and 4, in which the concentration, temperature, and immersion time when immersing the stainless steel material in an sulfuric acid aqueous solution are set to satisfy the above relationship of Expression (1), is formed with the passivation film 11 that has the surface of which the Cr/O value and Cr/Fe value are controlled within the above ranges when measured by Auger electron spectroscopy analysis. It has also been confirmed from the results of Table 1 that the gold plated layer 20 formed on the passivation film 11 has excellent plating property and interfacial adhesion property.

In addition, it has been confirmed from the results of Table 1 that the gold plated layer 20 formed on the passivation film 11 has excellent plating property and interfacial adhesion property in each of Examples 1 to 13, in which the concentration, temperature, and immersion time when immersing the stainless steel material in an sulfuric acid aqueous solution are set to satisfy the above relationship of Expression (1).

It has been confirmed from the results of FIG. 5 that, in Example 3 of immersing the stainless steel material in a sulfuric acid aqueous solution, the peak near a diffraction angle of 66° originated from plane orientation (2.2.0) of a crystal of CrOxide and the peak near a diffraction angle of 75° originated from plane orientation (2.2.0) of a crystal of Cr0.4Ni0.6 are smaller than those of SUS316L without being immersed in a sulfuric acid aqueous solution, and the content ratio of CrOxide and Cr0.4Ni0.6 is thus reduced in the stainless steel sheet 10. In consideration of this confirmation, it appears that, in Example 3, the Cr intensity at the surface of the passivation film 11 formed on the stainless steel sheet 10 is reduced due to the immersion in a sulfuric acid aqueous solution, resulting in a reduced Cr/O value and

TABLE 2

| | | | | | | | Gold plater layer | |
|---|---|---|---|---|---|---|---|---|
| | | Concentration | Temperature | Immersion time | Pasivation film | | Plating | Interfacial adhesion |
| | Type of acid | [vol %] | [° C.] | [seconds] | Cr/O value | Cr/Fe value | property | property |
| Comparative Example 10 | Hydrochloric acid | 5 | 60 | 30 | 0.3783 | 1.0769 | x | N.D. |
| Comparative Example 11 | | | | 60 | — | — | x | N.D. |
| Comparative Example 12 | | | | 300 | 0.4126 | 1.0922 | x | N.D. |
| Comparative Example 13 | | 10 | | 30 | — | — | x | N.D. |
| Comparative Example 14 | | | | 60 | — | — | x | N.D. |
| Comparative Example 15 | | | | 300 | — | — | x | N.D. |
| Comparative Example 16 | | 25 | | 10 | 0.4157 | 1.16627 | x | N.D. |
| Comparative Example 17 | | | | 30 | — | — | x | N.D. |
| Comparative Example 18 | | | | 60 | — | — | x | N.D. |
| Comparative Example 19 | | | | 60 | — | — | x | N.D. |
| Comparative Example 20 | | | | 60 | — | — | x | N.D. |
| Comparative Example 21 | | | | 120 | 0.4664 | 1.4352 | x | N.D. |
| Comparative Example 22 | | | | 300 | — | — | x | N.D. |
| Comparative Example 23 | Sulfuric acid + | Sulfuric acid: 6 | 70 | 30 | 0.4374 | 1.1295 | x | N.D. |
| Comparative Example 24 | Phosphoric acid | Phosphoric acid: 4 | | 60 | — | — | x | N.D. |
| Comparative Example 25 | | | | 300 | — | — | x | N.D. |
| Comparative Example 26 | | Without immersion | | | 0.3655 | 1.018 | x | N.D. |

It has been confirmed from the results of Table 1 that the gold plated layer 20 formed on the passivation film 11 has excellent plating property and interfacial adhesion property in each of Examples 1, 2, and 4, in which the stainless steel sheet 10 is formed with the passivation film 11 that has the surface of which the Cr/O value is within a range of 0.05 to 0.2 and the Cr/Fe value is within a range of 0.5 to 0.8 when measured by Auger electron spectroscopy analysis.

a reduced Cr/Fe value, which are thereby controlled in the above ranges at the surface of the passivation film 11, when measured by Auger electron spectroscopy analysis.

As shown in FIG. 2, in particular as shown in the graph of FIG. 2(A), Example 2, in which the concentration, temperature, and immersion time when immersing the stainless steel material in an sulfuric acid aqueous solution are set to satisfy the above relationship of Expression (1), has a larger peak of Fe (metal) near 707 eV than that of SUS316L (untreated) without being immersed in a sulfuric acid aqueous solution. It can thus be confirmed that an active elementary substance of iron (Fe (metal)) is exposed at the surface of the passivation film 11 formed.

As shown in FIG. 4, it has been confirmed that each of Examples 1 to 4, in which the concentration, temperature, and immersion time when immersing the stainless steel material in an sulfuric acid aqueous solution are set to satisfy the above relationship of Expression (1), has a larger arithmetic average roughness Ra than that before immersion in a sulfuric acid aqueous solution (immersion time of 0 seconds), thereby to have excellent plating property and interfacial adhesion property, due to an anchor effect, of the gold plated layer 20 formed on the passivation film 11.

As shown in FIGS. 6 and 7, it has been confirmed that Example 2, in which the concentration, temperature, and immersion time when immersing the stainless steel material in an sulfuric acid aqueous solution are set to satisfy the above relationship of Expression (1), has a different crystal structure than that of SUS316L (untreated) at the surface of the stainless steel material 10.

Specifically, the results of FIG. 6(A) and FIG. 6(C) show that Example 2 has a rougher profile of the surface of the stainless steel material 10 than that of SUS316L (untreated) due to the sulfuric acid aqueous solution. In addition, Example 2 was measured as having a diffraction pattern from a crystal containing a relatively large amount of an elementary substance of iron as shown in FIG. 7(A), while SUS316L (untreated) was measured as having a diffraction pattern from a crystal of oxide of chromium as shown in FIG. 7(C). It has thus been confirmed that Example 2 has a different crystal structure than that of SUS316L (untreated) at the surface of the stainless steel material 10 thereby to expose a crystal that contains a relatively large amount of an elementary substance of iron.

On the other hand, it has been confirmed from the results of Tables 1 and 2 that the gold plated layer 20 formed on the passivation film 11 has poor plating property and interfacial adhesion property in each of Comparative Examples 1, 2, and 26, in which the Cr/O value and Cr/Fe value at the surface of the passivation film 11 formed do not fall within the above ranges when measured by Auger electron spectroscopy analysis. It has also been confirmed from the results of Tables 1 and 2 that the gold plated layer 20 formed on the passivation film 11 has poor plating property and interfacial adhesion property in each of Comparative Examples 1 to 9, in which the concentration, temperature, and immersion time when immersing the stainless steel material in an sulfuric acid aqueous solution do not satisfy the above relationship of Expression (1), and in each of Comparative Examples 10 to 25, in which the stainless steel material is immersed in an acidic aqueous solution other than a sulfuric acid aqueous solution.

As shown in FIG. 3, in Comparative Example 26 without immersing the stainless steel material in a sulfuric acid aqueous solution, the above Cr/O value and Cr/Fe value were excessively high because of a large content ratio of Cr in an oxide film formed intrinsically on the surface of the stainless steel material, as described above. Also in Comparative Examples 1 and 2 without the above relationship of Expression (1) being satisfied by the concentration, temperature, and immersion time when immersing the stainless steel material in an sulfuric acid aqueous solution, the above Cr/O value and Cr/Fe value were excessively high, because the above oxide film was perfectly (or substantially perfectly) removed from the surface of the stainless steel sheet, so that the stainless steel sheet would be eroded by the sulfuric acid aqueous solution after the formation of the passivation film 11 on the stainless steel sheet thereby to lead to preferential dissolution of iron, as described above, thus relatively increasing Cr.

As shown in FIG. 2(A), Comparative Example 2, in which the concentration, temperature, and immersion time when immersing the stainless steel material in an sulfuric acid aqueous solution do not satisfy the above relationship of Expression (1), has a smaller peak of Fe (metal) near 707 eV than that of Example 2. It can thus be confirmed that the ratio of an active elementary substance of iron (Fe (metal)) is reduced at the surface of the passivation film 11 formed.

As shown in FIG. 2(B), Comparative Example 2 has larger peaks of an oxide of nickel (Ni—O) near 874 eV and 856 eV than those of Example 2. It can thus be confirmed that the ratio of the oxide of nickel, which has a property of being very brittle, is increased at the surface of the passivation film 11 formed.

As shown in FIG. 6(B), it can be confirmed that Comparative Example 2, in which the concentration, temperature, and immersion time when immersing the stainless steel material in an sulfuric acid aqueous solution do not satisfy the above relationship of Expression (1), is structurally brittle because the surface of the stainless steel material 10 is corroded in an ant colony-like form. In addition, as shown in FIG. 7(B), Comparative Example 2 is measured as having a diffraction pattern from a crystal that contains a relatively large amount of an oxide of nickel. It can thus be confirmed that the crystal structure at the surface of the stainless steel material 10 has varied to increase the ratio of an oxide of nickel which has a property of being very brittle.

With regard to Example 4, the thickness of the gold plated layer 20 was measured, and measurement of the coverage of the gold plated layer 20 was performed in accordance with the above-described method. Results are listed in Table 3 and shown in FIG. 8(A) to FIG. 8(C).

Figure 8:
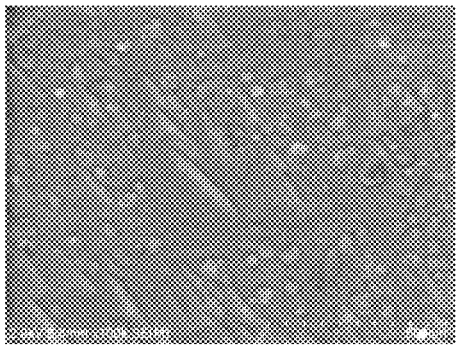
FIG. 8 is a set of SEM images of the surface of a gold plate coated stainless material 100 obtained in the example.
Figure 8:
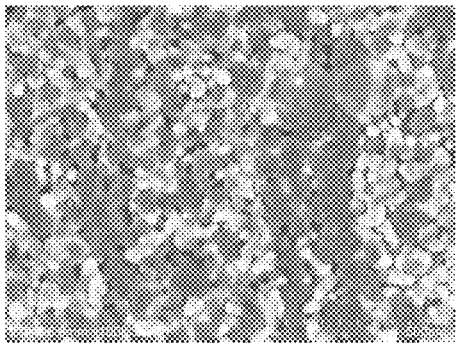
Figure 8:
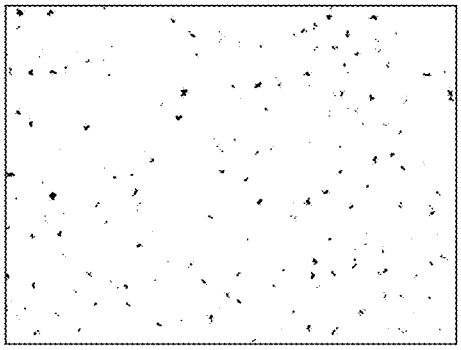

FIG. 8(A) is a SEM image before formation of the gold plated layer 20, FIG. 8(B) is a SEM image after formation of the gold plated layer 20, and FIG. 8(C) is an image obtained by image processing of the SEM image of FIG. 8(B). In FIG. 8(C), white parts in the image represent parts at which the gold plated layer 20 is formed, while black parts in the image represent parts at which the gold plated layer 20 is not formed.

TABLE 3

| | | | | Immersion | | | Gold plated layer | | |
|---|---|---|---|---|---|---|---|---|---|
| | | Concentration | Temperature | time | Passivation Film | | Thickness | Thickness | Coverage |
| | Type of acid | [vol %] | [° C.] | [seconds] | Cr/O value | Cr/Fe value | [nm] | [mg/cm$^2$] | [%] |
| Example 4 | Sulfuric acid | 25 | 70 | 20 | 0.092 | 0.5577 | 2.6 | 0.0076 | 98.2 |

It has been confirmed from the results of Table 3 and FIG. 8(A) to FIG. 8(C) that the gold plated layer 20 is well formed and the coverage is a high value of 98.2% in Example 4, in which the stainless steel sheet 10 is formed with the passivation film 11 that has the surface of which the Cr/O value is within a range of 0.05 to 0.2 and the Cr/Fe value is within a range of 0.5 to 0.8 when measured by Auger electron spectroscopy analysis and the gold plated layer 20 is formed on the passivation film 11.

Example 14

A gold plate coated stainless material 100 was produced in the same manner as in Example 4 except that a gold plated layer 20 having a thickness of 2.8 nm was formed by changing the condition of electroless plating process when forming the gold plated layer 20, and evaluation of the corrosion resistance and measurement of the contact resistance value were performed in accordance with the above-described methods. Results are shown in FIGS. 9 and 11.

Figure 9:
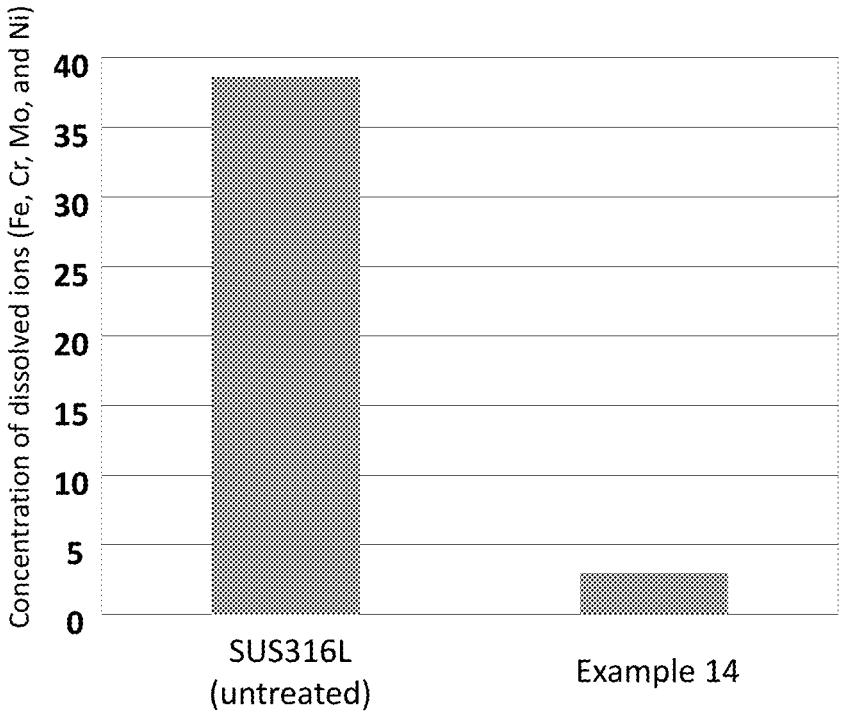
FIG. 9 is a graph which shows results when the corrosion resistance was evaluated for a gold plate coated stainless material 100 obtained in the example.

It has been confirmed from the results of FIG. 9 that Example 14, in which the stainless steel sheet 10 is formed with the passivation film 11 that has the surface of which the Cr/O value is within a range of 0.05 to 0.2 and the Cr/Fe value is within a range of 0.5 to 0.8 when measured by Auger electron spectroscopy analysis and the gold plated layer 20 is formed on the passivation film 11, can effectively suppress the dissolution of ions from the stainless steel sheet and thus has excellent corrosion resistance compared with SUS316L used as a conventional material for a separator for fuel cells, etc., even when the thickness of the gold plated layer 20 is thin, e.g., about several nanometers.

Figure 11:
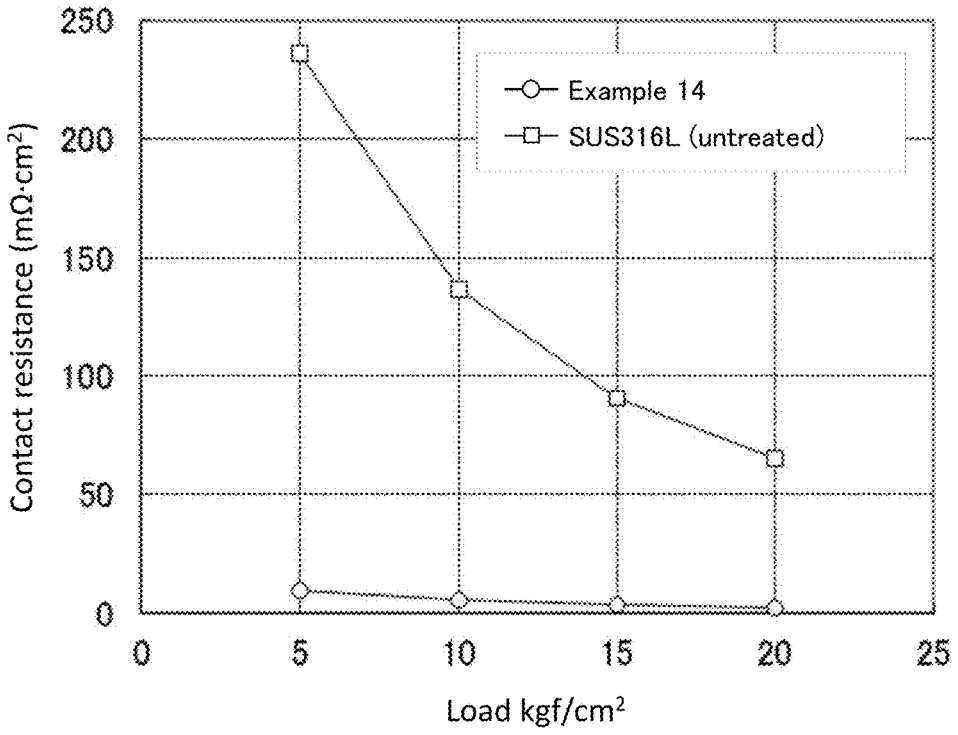
FIG. 11 is a graph which shows results when the contact resistance was measured for a gold plate coated stainless material 100 obtained in the example.

It has also been found from the results of FIG. 11 that Example 14, in which the stainless steel sheet 10 is formed with the passivation film 11 that has the surface of which the Cr/O value is within a range of 0.05 to 0.2 and the Cr/Fe value is within a range of 0.5 to 0.8 when measured by Auger electron spectroscopy analysis and the gold plated layer 20 is formed on the passivation film 11, exhibits a lower contact resistance value at any load value and thus has excellent conductivity compared with SUS316L used as a conventional material for a separator for fuel cells, etc.

What is claimed is:

1. A gold plate coated stainless material comprising:

a stainless steel sheet coated with a gold plated layer which is deposited directly on a passivation film present on a surface of the stainless steel sheet, wherein the passivation film has a surface composition having a Cr/O value comprised within a range from 0.05 to 0.2 and a Cr/Fe value comprised within a range from 0.5 to 0.8, the Cr/O value and the Cr/Fe value obtained by Auger electron spectroscopy analysis.

2. The gold plate coated stainless material according to claim 1, wherein the gold plated layer has a coverage of 95% or more.

3. A method of producing a gold coated stainless material according to claim 1, the method comprising:

immersing a stainless steel sheet in a sulfuric acid aqueous solution; and forming a gold plated layer on the stainless steel sheet, wherein the stainless steel sheet is immersed in the sulfuric acid aqueous solution to satisfy Expression (1) below:

$$0.6\times10^6 \le x^2\cdot(y-40)^2\cdot\sqrt{z} \le 3.0\times10^6 \quad (1)$$

where x represents a sulfuric acid concentration [vol %] of the sulfuric acid aqueous solution ($20\le x\le 25$), y represents a temperature [° C.] of the sulfuric acid aqueous solution, and z represents an immersion time [seconds] when the stainless steel sheet is immersed in the sulfuric acid aqueous solution.

4. A method of producing a gold plate coated stainless material, the method comprising:

immersing a stainless steel sheet in a sulfuric acid aqueous solution so as to form a passivation film on the stainless steel sheet, the passivation film having a surface of which a Cr/O value is within a range of 0.05 to 0.2 and a Cr/Fe value is within a range of 0.5 to 0.8 when measured by Auger electron spectroscopy analysis; and forming a gold plated layer directly on the passivation film of the stainless steel sheet.

5. The gold plate coated stainless material according to claim 1, wherein the ratio (Fe (metal)/Fe (total)) of an elementary substance of iron (Fe (metal) to the total amount of Fe atoms (Fe (total)) at the surface of the passivation film is 14% or more.

6. The gold plate coated stainless material according to claim 1, wherein the ratio (Ni (metal)/Ni (total)) of an elementary substance of nickel (Ni (metal) to the total amount of Ni atoms (Ni (total)) at the surface of the passivation film is 18% or more.

7. The gold plate coated stainless material according to claim 1, wherein an arithmetic average roughness Ra of the passivation film is 0.015 μm or more.

8. The gold plate coated stainless material according to claim 1, wherein the thickness of the gold plated layer is within 2 to 20 nm.

* * * * *